United States Patent [19]

Howald

[11] Patent Number: 5,048,586

[45] Date of Patent: Sep. 17, 1991

[54] GUIDE RAIL ASSEMBLY

[76] Inventor: Gerald Howald, Saseler Str. 113, 2000 Hamburg 73, Fed. Rep. of Germany

[21] Appl. No.: 473,602

[22] Filed: Feb. 1, 1990

[30] Foreign Application Priority Data

Feb. 3, 1989 [DE] Fed. Rep. of Germany ... 8901384[U]

[51] Int. Cl.[5] ..... E06B 9/36

[52] U.S. Cl. ..... 160/168.1; 160/178.1; 160/900

[58] Field of Search ..... 160/168.1, 178.1, 900, 160/166.1, 172, 173

[56] References Cited

U.S. PATENT DOCUMENTS 4,653,564 3/1987 Marocco ..... 160/900 X

FOREIGN PATENT DOCUMENTS 166625 1/1986 European Pat. Off. .
3151682 7/1983 Fed. Rep. of Germany .
8704057 7/1987 World Int. Prop. O. .

*Primary Examiner*—Carl D. Friedman
*Assistant Examiner*—Derek J. Berger
*Attorney, Agent, or Firm*—Fay, Sharpe, Beall, Fagan, Minnich & McKee

[57] ABSTRACT

A guide rail assembly has a serial arrangement of linked carriages movable by pull cord or string along the rail and provided for the fixing of hanging parts such as blind slats. At least two carriages serve as pull carriages and each has a locking receptacle, whereas the pull cord is provided with at least one locking part fixed thereon. Each locking receptacle for the locking part forms a locking fit transport-fixed in both pulling directions of the pull cord, but detachable by a pulling force instantaneously exerted on the pull cord.

15 Claims, 3 Drawing Sheets

GUIDE RAIL ASSEMBLY

BACKGROUND OF THE INVENTION

1. Field of the Invention

The invention relates to a guide rail assembly comprising a guide rail and carriages carrying hanging parts such as curtains, slats of blinds or the like and guided along the rail attached to a solid base such as a wall, a ceiling or the like. The carriages are jointly movable in both rail directions by means of a pull cord running along the rail.

Onto the carriages or travellers of such a guide or assembly rail are hung in particular strip-like slats, in order to form a slatted curtain, panel drapes or vertical blinds for windows, for separating or dividing up room areas, etc. For opening such a curtain the carriages that form a set or pack of slats are moved together at one rail end on one side of the curtain, whilst for a partial opening position or closed position of the curtain the carriages are moved along the rail in unitary spaced positions. By means of a known reversing or turning mechanism on the carriages, the slats can be brought into an angular, specifically a perpendicular, position relative to the curtain surface (open position) or a position parallel to the curtain surface with slightly overlapping slat edges (closed position). Apart from curtain slats, the guide rail carriages can also carry hanging elements such as decorative strips, pictures, design elements, electric light fittings, display parts for advertising purposes, etc., so that said hanging parts can be grouped on one side of the rail or can be arranged in distributed, spaced manner along the rail and about the same.

2. Description of the Related Art

In order to produce a set or pack formation of a vertical blind with slats either at the right- or left-hand end of a guide rail, it is known (DE-OS 31 51 682) to connect a carriage arranged at each end of a guide rail by means of a screw either to a pull cord to form a pull carriage or to the rail to form a fixing element. Thus, a pack of slats can only be arranged in areas defined by the rail ends, and installation work using a screwdriver is required. After one of the carriages has been fixed to the rail, the pack of slats can only be drawn up in one direction. Thus, the known guide rail must be designed and fitted for the specific type of intended use right from the outset. For final installation the movement and/or pack areas desired for the slats must be known and measured. These areas are e.g. bound by the opening area of casements or by the size of window openings. As a result of the predetermined slat pack arrangement, it is also necessary to use a rail precisely adapted to the intended use and/or to provide a position of the pull cord pertaining to the specific requirements. Thus, the assembly or installation work is relatively time-consuming. When operating the known vertical blind, the user is bound by the pack position set up at one end of the guide rail, so that the slatted curtain cannot at all be adjusted o is not readily adjustable to instantaneously occurring and changing spatial circumstances, light conditions, glare and/or vision protection positions.

Another known guide rail (EP-A-O 166 625) is provided for operating at the same time a longer guide rail portion and a shorter guide rail portion of a two-part curtain. For this purpose a bulge is positioned on a pull or draw cord at a specific distance from a pull carriage, so that only after covering that predetermined distance does the bulge reach the pull carriage and move it in one direction. In order to bring curtain portions with different guide rail lengths against one another in the closed position, according to another embodiment disclosed by EP-A-O 166 625, fixing parts of a pull carriage or bulge parts are arranged in frictional or sliding engagement with a pull cord and movable against the latter. It is also known from EP-A-O 166 625 to arrange a pull cord bulge between the walls of a pull carriage, so that in this way the cord is firmly and durably connected to the carriage.

Another known vertical slatted curtain (WO-A-8704057) comprises a guide rail with slides guided along the same. The slides are fixed to an elastic cord, so that when the curtain is open the slides are closely juxtaposed in a lateral pack, whilst being movable out of the pack position at identical and uniformly enlargeable spacings.

With the known vertical slatted curtains according to EP-A-O 166 625 and WO-A-8704057 the packs of slats are always provided in an end region of a guide rail and the slides or carriages of each set are only moved apart in one closing direction. For each particular purpose a specially designed rail and therefore specially related measuring and installation work are required. The user is bound by the pack position installed once and for all. The pack areas and the movement area of the slat slides or carriages of a mounted guide rail cannot be adapted to modified wishes and/or use situations, or alternatively this requires extensive reequipping and installation work.

3. Objects of the Invention

A major object of the invention is to provide a guide rail for hanging parts, which is of relatively simple construction and can be easily installed. Another essential object of the invention lies in that hanging part carriages or travellers guided by the rail can be moved, grouped and/or positioned optionally within desired sections of the rail in a controlled manner by operating pull cord.

SUMMARY OF THE INVENTION

In a guide rail assembly including at least one serial arrangement of carriages guided along the rail and designed for attaching hanging parts thereto, which carriages are interlinked in such a way that they are jointly movable in both directions thus acting as passive carriages by means of an elongated pull cord or the like extending along the rail, the pull cord, for transporting the carriages, being designed to engage a carriage serving as an active pull carriage and terminating the carriage serial arrangement, the pull cord otherwise passing in an unobstructed manner the remaining carriage, which thus act as passive carriages. The above objects are achieved according to the invention in that each of at least two carriages operated as pull carriages comprises a locking receptacle, and the pull cord is provided with at least one locking part fixedly arranged thereon. The pull cord is movable in an unobstructed manner relative to each locking receptacle, so that the latter forms a locking fit for the locking part. The locking fit is transport-fixed in both pull cord pulling directions, but is detachable by a pulling force instantaneously exerted on the pull cord, whilst the locking part is arranged to move in an unimpeded manner relative to the passive carriages.

Thus, according to the invention, by control by means of the pull cord, as required, one of at least two pull carriages is either moved by the locking part or element or remains stationary at a desired point. The passive or travelling carriages are moved against a stationary pull carriage or away therefrom with another pull carriage locked for this purpose by means of the pull cord. Depending on its respective condition, the locking element or part engages or disengages the pull carriage locking receptacle through instantaneously increased pulling force on the pull cord. Consequently, a pull carriage either stops through unlocking with the pull cord, or it is transported by locking therewith. At desired positions or portions along the rail it is possible to provide carriage packs, groups or sets formed by carriages pushed together and/ or to use carriage movement areas, so as to e.g. provide slat sun protection, slat vision protection, specific hanging part decoration or room arrangements, according to individual desires and requirements. In general, the grouping and/or movement area of hanging parts of a mounted guide rail can be adapted easily by operating the pull cord to changed requirements of decoration or use. This universal design possibility is brought about by one and the same guide rail assembly according to the present invention, so that there is no need to arrange, fit, keep available and/or design different guide rails. A single guide rail, can be equipped for different uses with a unitary, standarized pull cord system.

According to a particularly expedient embodiment of the invention, a basic construction of a guide rail assembly comprises a serial arrangement of the carriages comprising a plurality of normal passive carriages and two pull carriages, in which the passive carriages are arranged between the pull carriages terminating the serial arrangement at both ends. In particular there are two such serial arrangements, which can be operated by an endless, i.e. continuous pull cord, so as to be able to simultaneously form in each one of two areas of a guide rail a single hanging part pack, e.g. a pack of slats of a blind. Depending on the specifically intended use there can also be more than two carriage serial arrangements for forming carriage groups or packs along the guide rail. Pull cords can be associated with individual carriage serial arrangements, respectively, or a single pull cord can be associated with a plurality of carriage serial arrangements, so that carriage groups can be formed by operating several pull cords or one single pull cord, only. It is also possible to provide on a pull cord several locking elements arranged in distributed manner along the guide rail, so that a grouping of carriages is always possible if there is one of the locking elements in the detachable arresting seat or fit with the locking receptacle of a pull carriage. Thus, group formations can be obtained selectively and intermittently on moving the pull cord over only a section of the total length thereof and carriages of a desired sequence can remain unchanged in their positions along the rail. It is evident that, through the number of pull carriages having locking receptacles, the number and spacings of the locking elements formed on the pull cord and/or the number of pull cord systems, it is possible to obtain a plurality of operating and arrangement possibilities for the transport or grouping of carriages. Therefore, numerous different designs for the arrangement of hanging parts become possible.

According to another embodiment of the invention the locking receptacle of a pull carriage is constructed as a through hole, through which the pull cord is passed in an unobstructed manner and which forms a fixed, but detachable clamping or friction fit for the locking element. The locking receptacle can be constructed with a stop blocking the passage of the locking element through the locking receptacle, so as to ensure that the pull cord locking element is only movable along the guide rail on one side of the pull carriage and can be unobstructedly moved pass the travelling carriages located in this area.

It is particularly advantageous to construct the locking receptacle in the form of a groove or slot and to construct the locking element as a resilient spring or key for firmly, but detachably engaging the groove or slot. The invention is not restricted to the construction of such a mechanical locking position. According to the general aspect of the invention, the locking element and locking receptacle can be constructed in the form of a clamping or snap fit or lock and can cooperate in this form, so as to engage or disengage the locking element and locking receptacle in the case of an instantaneously higher or abrupt pull force on the pull cord. A detachable arresting fit can also be in the form of a burr or Velcro closure wherein a barb-possessing pull cord locking element can be engaged with or disengaged from a similar barb-possessing wall or surface of the lockforming receptacle. According to a further embodiment of the invention the locking fit or closure is formed so that the locking element is formed by a magneticizable member or element attached to the pull cord, and so that the pull carriage locking receptacle comprises a permanent magnet, so that the detachable locking position can be brought about by means of a magnetic connection of the locking element and the locking receptacle. Of course, the locking element can also be constructed as a permanent magnet, and the locking receptacle may be designed with magnetizable parts, surfaces or portions.

According to an expedient development of the invention the arresting fit is constructed in that the locking receptacle has a cage-like space, as well as a hole, slot or gap-like recess being elastically resilient along at least one edge and that the locking element is constructed as a preferably spherically raised part on the pull cord, the raised part being adapted to pass through the recess for reaching the locking position in or for being released from the cage space under instantaneous pulling force on the pull cord and against a resilient giving way of the recess edge.

With respect to very simply fitting with universally usable components and therefore a cost-saving, compact construction of the guide rail assembly, the locking receptacle can be arranged on a carriage part, which is formed in one piece with a passive carriage. The carriage part with the locking receptacle is firmly connected to the passive carriage in particular in modular construction by means of slot and key or groove and tongue elements by plug connection. In particular there is a plug module, which is inserted into a cord passage opening of a conventional or standard travelling (passive) carriage. A through hole is provided in the plug module for the return of a pull cord.

For the operation of one or more serial carriage arrangements from one end of the guide rail assembly, a guide pulley or roller can be, provided in the region of the opposing guide rail end, and by means of which the pull cord is moved as a continuous pull cord backwards and forwards along the guide rail.

According to the general aspect of the invention and taking into account the various possibilities of the application, the pull cord may be formed differently. In particular, it may be provided by way of a string, a rope, a ribbon, a flat band or also in the form of a chain having links. Such cord elements will, for the purposes of the invention, carry at least one locking element.

BRIEF DESCRIPTION OF THE DRAWINGS

Other and further objects of the present invention will be apparent from the following description and claims and are illustrated in the accompanying drawings which by way of illustration schematically show preferred embodiments of the present invention and the principles thereof and what now are considered to be the best modes contemplated for applying these principles. Other embodiments of the invention embodying the same or equivalent principles may be used and structural changes may be made as desired by those skilled in the art without departing from the present invention and the scope of the appended claims. In the drawings

DETAILED DESCRIPTION OF THE PREFERRED EMBODIMENTS

Figure 1:
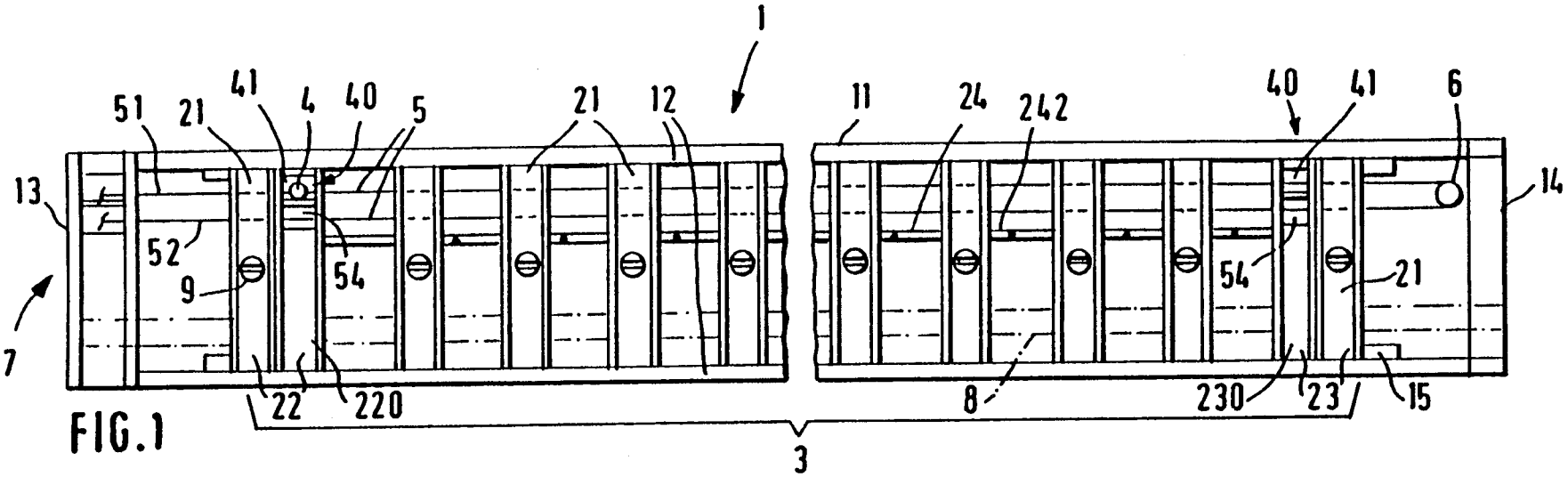
FIG. 1 shows a bottom view of a guide rail assembly according to the invention.
Figure 2:
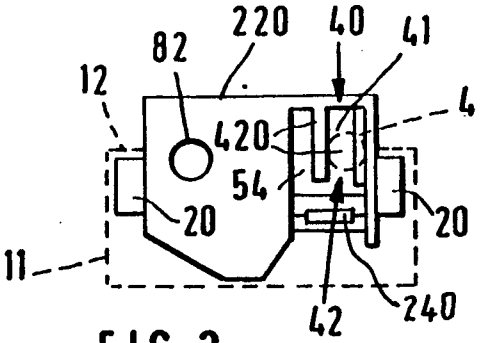
FIG. 2 shows a side view of a pull carriage of a guide rail assembly according to the invention.
Figure 3:
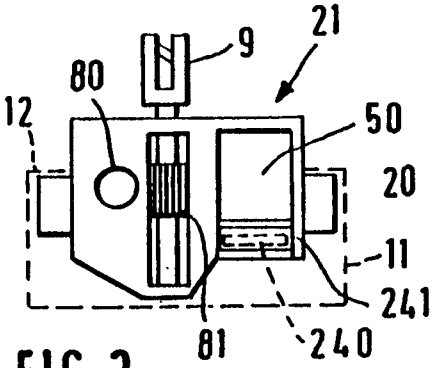
FIG. 3 shows a side view of a passive (travelling) carriage.

In a guide rail assembly designed according to the present invention, and as shown in FIGS. 1 to 3, a guide and carrier rail 1 is formed by an elongated element of U-shaped profile of suitable material, which profile is open on one side and by Which hanging parts such as a curtain, slats of a blind or the like are carried. The U-shaped profile forms a housing 11 with guides 12 on the profile opening edges. Carriages 21, 22, 23 extending over the profile cross-section each have a pair of wheels or slide elements, which run or slide on the guides 12. The guide rail assembly comprises several travelling or passive carriages 21, which are arranged between two pull carriages 22, 23 laterally terminating an overall carriage serial arrangement 3 of the assembly.

The passive carriages 21 are constructed in a se known manner forming narrow bodies when seen in a direction parallel to the guide rail 1. On its underside each passive carriage 21 is provided with a hook or lock 9, to which is fixed a hanging part not shown. The hanging part lock 9 is carried by a pinion shaft 81, which is driven by a worm gear fixed to a reversing shaft 8 to rotate therewith and arranged within passive carriage 21 in the region of a through bore 80. The reversing shaft 8 extends over the length of the guide rail 1 and is rotatably mounted with its shaft ends on end caps or covers 13, 14 frontally closing the profile of the guide rail 1. Through rotating the shaft 8, the locks or hooks 9 are jointly rotated in the same direction, so as to bring curtain slats suspended thereon into positions either transversal to or planar with the (imaginary) curtain surface.

Each passive carriage 21 is provided with a passage 50 for a continuous and/or endless pull cord 5 extending over the entire length of the guide rail 1 and deflected by means of a guide pulley 6 located close to or at the end cap 14. The pull cord 5 is led downwards out of the other end cap 13 and is operated, like the reversing shaft 8, on the side of the guide rail end cap 13 (operating side 7).

Figure 4:
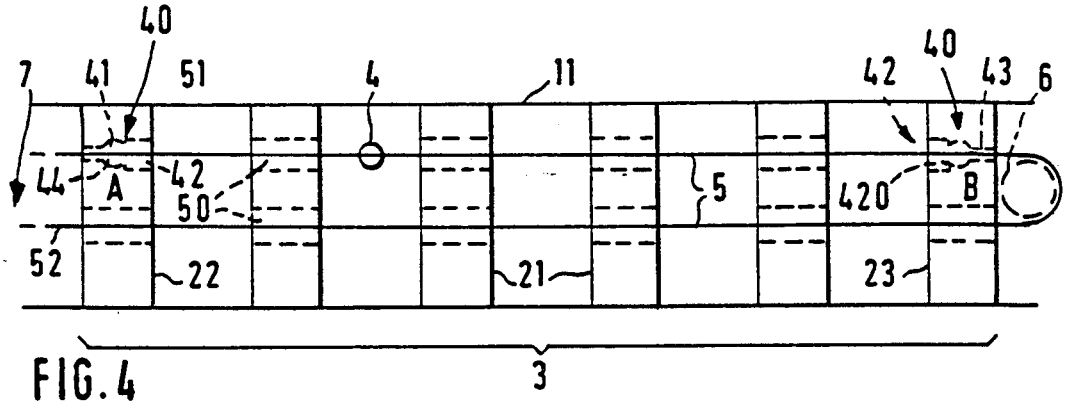
FIG. 4 to 7 show certain principal positions of carriages and carriage packs (groupings) of a guide rail assembly according to the invention provided with a continuous pull cord.

Between two neighbouring passive carriages 21 is provided a carriage connecting and spacing member in the form of a metal strip 24 (FIG. 1) or 240 (FIG. 3). Such a metal strip is fixed by one end to a carriage 21, whilst passing through an opening 241 of an adjacent passive carriage and is provided at its free end with a blocking edge 242 blocking the passage through the opening 241. The metal strips 24, 240 lead to a chain or link connection of the guide rail carriages 21, 22, 23 in such a wa that the carriages can be moved together and successively to virtually a zero spacing, whilst being movable between two carriages to a fixed and in particular equal spacing, the complete row of linked carriages being drawn and optionally transported along the guide rail by a pull carriage 22, 23. The guide rail according to FIG. 1 and a position diagram according to FIG. 4 show the carriages in uniformly spaced apart positions.

The carriage serial arrangement 3 in FIG. 1 is laterally terminated by the pull carriages 22 and 23. Each of the pull carriages includes a passive carriage 21. The latter is in each case fixed to a pull carriage portion 220 or 230 facing the carriage row. The carriage portions 220, 230 are integral, one-piece components the pull carriages 22, 23 respectively. It is in particular appropriate to construct the carriage portion 220, 230 as a plug modular component not shown in detail in the drawing, so as to produce in the fitted state of the guide rail 1 a firm plug connection with the passive carriage 21.

The pull carriage portion 220, which corresponds to pull carriage portion 230, is shown in FIG. 2. Its body contours correspond to those of a passive carriage 21 and it is also provided with a runner or slide element pair 20 guided by the rail edge guides 12. The reversing shaft 8 passes in unimpeded manner through a passage bore 82. In place of a passage 50 of a passive carriage 21, there is a locking receptacle 40, which surrounds a cage-like inner area 41. The latter is bounded by a slot 42 in a lateral direction, i.e. to the sides of carriage 21. At least the slot 42 facing the row of passive carriages 21 is provided with at least one elastically resilient edge, projection or web portion 420. Thus, the locking receptacle 40 forms a fixed, but detachable locking seat or fit for a spherical pull cord locking element 4. The spherical portion thereof arranged on pull cord 5 or in the pull cord path constitutes a thickening compared with the pull cord cross-section, which is dimensioned in such a way that it can only pass by jerky or instantaneous action under an abrupt pulling force exerted on the pull cord 5 through the slot 42, accompanied by a slight spreading apart of its spring portion 420. The pull cord 5 passes in unimpeded manner through the slots 42 of the pull carriage portion 220. If the locking element 4 comes to rest within the cage 41 (FIG. 1), the pull cord 5 is adequately firmly connected thereto for the transport of the pull carriage 22. However, the locking element 4 can be released from its locking position again by a briefly increased (abrupt) pulling force, or jerk, on the pull cord 5, and will pass through the spring slot 42. The passages 50 of the passive carriages 21 have an internal overall width which, in each direction, is larger than the cross-section of the locking element 4, so that it traverses the passive carriages 21 in unobstructed manner. The pull carriage portion 220 is provided with a passage opening 54 for the passage of a pull cord counter-run 52.

By pulling the pull cord counter-run 52 on the operating side 7 of guide rail 1 in FIG. 1, the pull carriage 22 is moved in the direction of the pull carriage 23, which engages stops 15. The carriages of the serial arrangement 3 are moved uniformly together until a pack of carriages positioned with no spacing is formed in front of the pull carriage 23.

The locking element 4 can also be freed from cage 41 of the pull carriage 22 (FIG. 1) by abrupt pulling on the pull cord run 52 and then without changing the positions of the carriages of the serial arrangement 3 can be moved with the pull cord 5 to the pull carriage 23, where it is arrested by means of a locking receptacle 40 constructed as for pull carriage 22. The carriages of the serial arrangement 3 can then be shoved together towards operating side 7 by pulling the pull cord run 51. Thus, also on the operating side a tightly juxtaposed carriage pack or group can be formed. In addition, groups of a carriage pack are possible at random positions along the guide rail 1. This is made clear by the principal diagrams according to FIGS. 4 to 7 for carriage positions and groups.

FIGS. 4 to 7 show carriage serial arrangements 3 of a guide rail profile 11, in which the carriages, as described relative to FIG. 1, can be moved and grouped from one operating side 7 with a continuous pull cord 5 and with pull carriages 22, 23 which can be fixed thereon selectively.

The locking receptacle 40 for the pull carriages 22, 23 is designed as a bore passing through each pull carriage. It comprises a spherical locking pocket 41, which forms the resting locking seat for the spherical portion of locking element 4 of the pull cord 5. An entry portion 42 of the passage bore is so constructed and dimensioned that the locking element 4 can only be passed in resilient manner under pulling force through this portion 42, which is partly restricted with respect to the cross-section of the sphere, so as to pass into or out of the cage 41. On the inner walls of bore portion 42 can be provided resilient leaf springs, projections or similar spring elements curving into the same. It is particularly appropriate to form the walls of the bore portion 42 from an elastic plastic. The pull carriages 22, 23, also in the embodiments according to FIGS. 1 and 2, are entirely made from plastic.

Figure 5:
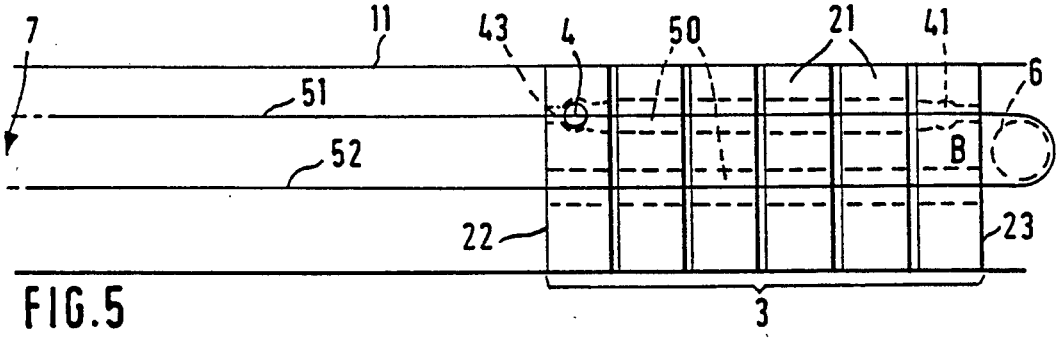
Figure 6:
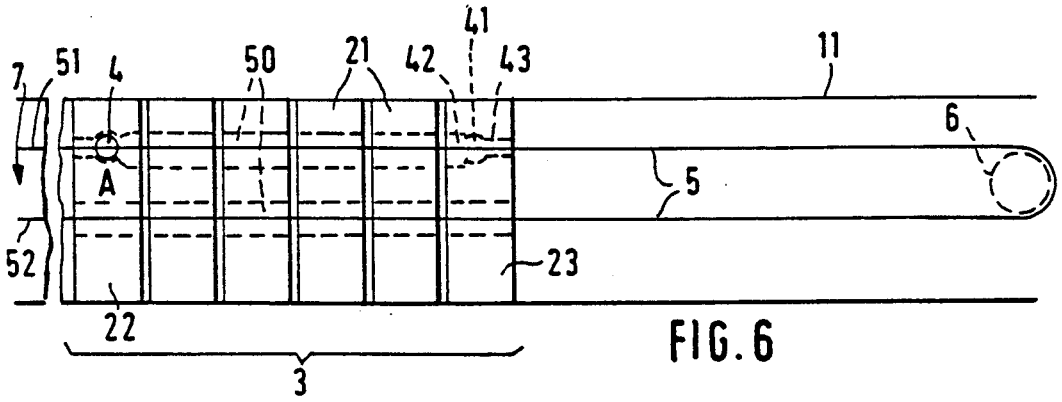

According to FIGS. 4 to 6 the bore 40 comprises a through hole 43 issuing into the cage 41 and which has a much smaller diameter than locking element 4 and only permits the unobstructed passage of pull cord 5, whilst blocking the passage of locking element 4 by forming a cage-side stop 44.

The pull cord spherical locking element 4 is brought out of the position shown in FIG. 4 into the cage rest position A. so that, whilst pulling on the cord run 52, the carriages can be brought into the pack/ group position according to FIG. 5. After freeing the locking element 4 from cage 41 of carriage 22 (by briefly increased pulling force on the cord run 52), the locking element 4 passes, accompanied by free passage through the recesses 50 of the passive carriages 21, into a position B within the cage 41 of pull carriage 23 (also by temporarily increased pulling force on run 52). Thus, by pulling on the cord run 51, the carriage pack of FIG. 5 can be moved in closed form in the direction of the operating side 7 into an intermediate position according to FIG. 6. By means of the pull cord 5 the locking element 4 is brought into the locking position A of FIG. 6. The carriage pack can then be moved, e.g. to another intermediate position along the guide rail profile 11. Accompanied by pulling on the cord run 51, the carriages can be drawn apart from there to the operating side 7, the pull carriage 23 initially remaining stationary due to its own weight or to the weight of a hanging part fixed thereto After obtaining fixed spacings brought about a carriage chain link not shown, the serial arrangement with such spaced carriages can be moved uniformly to the operating side 7, whilst pulling on the locked pull carriage 22.

Figure 7:
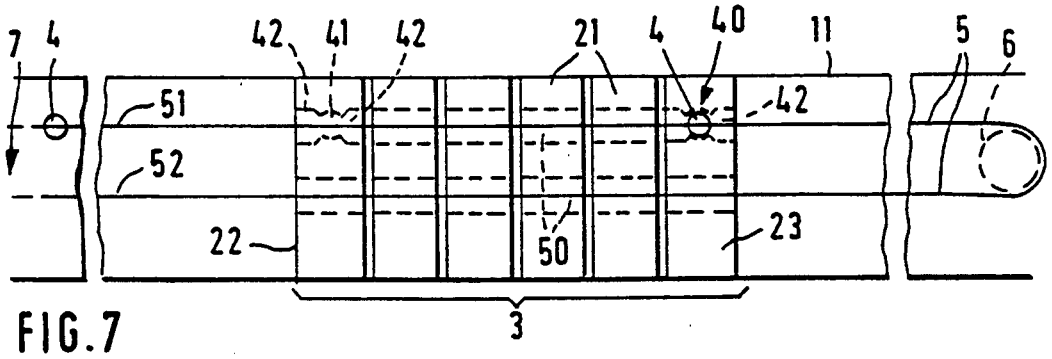

The locking receptacles 40 of each one of the pull carriages 22 and 23 according to FIG. 7 comprise on both running direction sides of the pull carriage springelastic bore portions constituting a clamping/ friction passage for the spherical part forming the locking element 4. Thus, the locking element 4 can be fixed in or freed from the cage 41 in both cord run directions. It is possible to provide along the pull cord 5 several locking elements 4, a closed transport as well as a drawing apart or moving together of a carriage pack always being possible if one of the spherical parts is located in a locking cage 41. It is possible to provide along the guide rail profile 11 additional correspondingly constructed carriage serial arrangements, not shown, that with the same pull cord 5 it is possible to position and move different carriage serial arrangements. It is, of course, possible to provide a guide rail 11 with oppositely movable carriages and/or packs, so as to be able to operate with a single pull cord a curtain subdivided into two sections.

Figure 8:
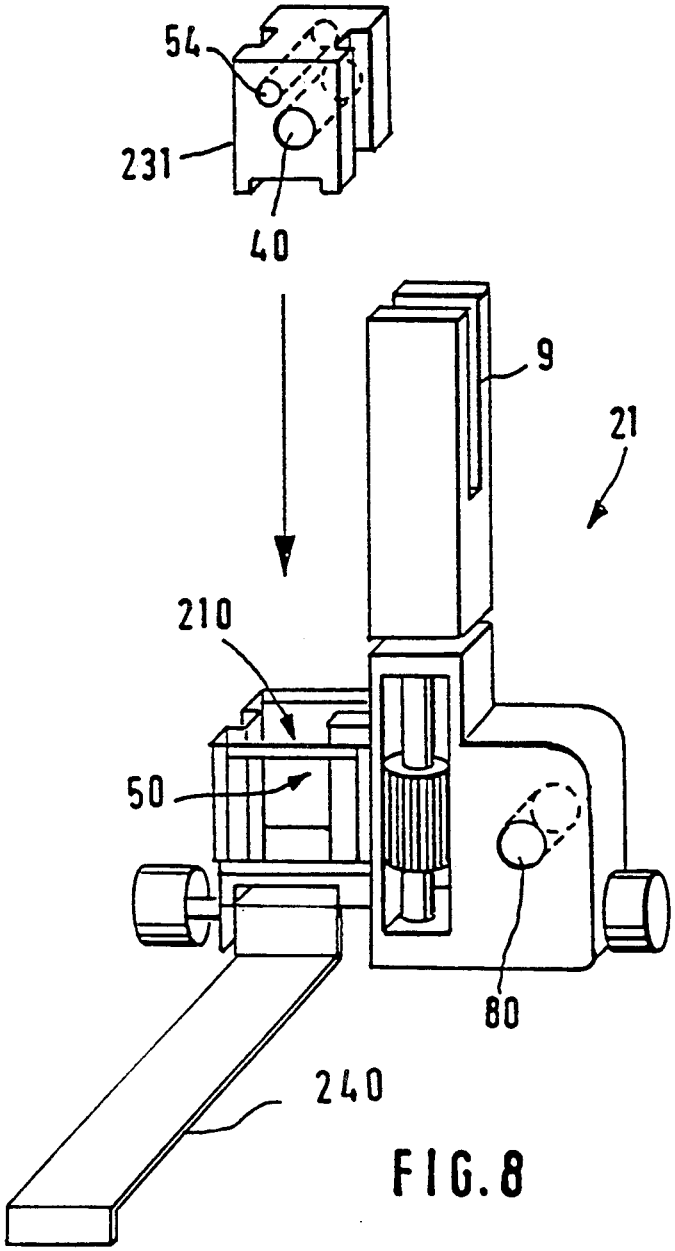
FIG. 8 represents two components of a pull carriage of a guide rail assembly according to the invention.

As becomes apparent from FIG. 8, a particularly advantageous embodiment of a pull carriage 22 or 23 is obtained by inserting a modular or plug component 231 into the through recess 50 of a conventional passive carriage 21 through an opening 210 on the carriage side having the lock 9. Component 231 is provided with a locking receptacle 40 forming the detachable arresting fit for a locking element 4. The plug component 231 also comprises a through hole 54 for the unobstructed passage of a pull cord counter-run. In the assembled state, the preferably plastic-made plug component 231 is in clamping or frictional fit in recess 50.

Figure 9:
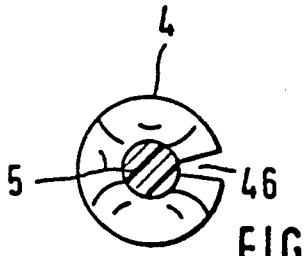
FIG. 9 represents a pull cord locking element of a guide rail assembly according to the invention.

A special embodiment of the spherical locking element 4 comprises, as shown in FIG. 9, a spherical hollow component having a slot 46, which is pressed onto the pull cord 5. The hollow component is resiliently compressible, at least partly brought about by the material of the pull cord 5 and accompanied by the constriction of slot 46. Thus, the locking fit can be produced in a locking receptacle by resilient-elastic force of the locking element 4.

According to yet another embodiment of the invention, the walls of the bores 40 are made from magnetizable materials, or, while the locking element material and spherical part 4 is magnetic. There is not need in this embodiment for locking rockets 41 and the reception diameters of the bores are dimensioned in such a way that they permit and entry or passage of the spherical locking element 4 not impeded by mechanical spring parts. However, the locking element 4 is held in each bore 40 by magnetic force in locking fit detachable by the pull cord.

What is claimed is:

1. A guide rail assembly, comprising:

a rail having first and second ends;

a plurality of carriages slidably attached to said rail for sliding along said rail, said plurality of carriages including a first active carriage and at least one passive carriage, wherein active carriage includes a first releasable engagement means;

means for sliding said carriages along said rail in first and second directions, including elongated pulling means for pulling at least said first active carriage, said elongated pulling means having first locking means for detachably fixedly engaging said first releasable engagement means to enable the first active carriage to slide in either one of said first and second directions upon pulling of said pulling elongated pulling means.

2. A guide rail assembly as claimed in claim 1, wherein said plurality of carriages further includes a second active carriage, wherein said at least one passive carriage is located between the first and second active carriages, said second active carriage including a second releasable engagement means.

3. A guide rail assembly as claimed in claim 2, wherein said elongated pulling means further comprises second locking means arranged to detachably fixedly engage said second releasable engagement means to enable the second active carriage to slide in said second direction upon pulling of said elongated pulling means.

4. A guide rail assembly as claimed in claim 2, wherein a pack arrangement is formed at a freely selectable location along the rail displaced from both the first and second rail ends when one of the first and second active carriages has been pulled by said pulling means a distance so that a minimum possible displacement separates said first and second active carriages.

5. A guide rail assembly as claimed in claim 1, wherein the first locking means and the first releasable engagement means include corresponding hook-and-loop means for mutual detachable fixed engagement.

6. A guide rail assembly as claimed in claim 1, wherein the first locking means and the first releasable engagement means include corresponding tongue-and-groove fastening means for mutual detachable fixed engagement.

7. A guide rail assembly as claimed in claim 1, wherein said first locking means comprises a relatively expandable and compressible portion of said elongated means, the portion being relatively expanded when the first locking means and the first releasable engagement means are in fixed engagement, and the portion being relatively compressed for detachment of the first locking means from the first releasable engagement means.

8. A guide rail assembly as claimed in claim 2, wherein said portion compresses to cause detachment of the first locking means from the first releasable engagement means when said elongated pulling means is abruptly pulled.

9. A guide rail assembly as claimed in claim 1, wherein said first releasable engagement means comprises a resilient locking receptacle for releasably receiving said first locking means.

10. A guide rail assembly as claimed in claim 9, wherein said resilient locking receptacle releases said first locking means when said elongated pulling means is abruptly pulled.

11. A guide rail assembly as claimed in claim 1, wherein the first releasable engagement means is a modular component, and wherein the first active carriage includes means for removably receiving the first modular releasable engagement means.

12. A guide rail assembly as claimed in claim 1, wherein each said passive carriage includes means for allowing the elongated pulling means and the first locking means to pass unobstructedly.

13. A guide rail assembly as claimed in claim 1, wherein the first locking means is of substantially spherical shape.

14. A guide rail assembly as claimed in claim 1, further comprising reversing pulley means around which the elongated pulling means is operably arranged for enabling two-direction movement of the elongated pulling means.

15. A guide rail assembly as claimed in claim 1, wherein one of said locking means and said first releasable engagement means comprises a magnetic material, and the other of said locking means and said first releasable engagement means comprises a material that is magnetically attracted to said magnetic material.

* * * * *